US011372371B2

(12) United States Patent
Kunimi et al.

(10) Patent No.: US 11,372,371 B2
(45) Date of Patent: Jun. 28, 2022

(54) WHEEL TRAIN DEVICE AND TIMEPIECE

(71) Applicant: CASIO COMPUTER CO., LTD., Tokyo (JP)

(72) Inventors: Ryoichi Kunimi, Fussa (JP); Yoshihiko Enta, Saitama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 797 days.

(21) Appl. No.: 16/142,062

(22) Filed: Sep. 26, 2018

(65) Prior Publication Data

US 2019/0094806 A1 Mar. 28, 2019

(30) Foreign Application Priority Data

Sep. 27, 2017 (JP) ..... JP2017-185877

(51) Int. Cl.
*G04B 19/02* (2006.01)
*G04C 3/14* (2006.01)
*G04B 19/24* (2006.01)

(52) U.S. Cl.
CPC ..... *G04B 19/02* (2013.01); *G04C 3/14* (2013.01); *G04B 19/241* (2013.01)

(58) Field of Classification Search
CPC ..... G04B 19/02; G04B 19/241
See application file for complete search history.

(56) References Cited

U.S. PATENT DOCUMENTS

| | | | |
|---|---|---|---|
| 7,215,602 | B2 | 5/2007 | Hirano et al. |
| 2006/0140057 | A1 | 6/2006 | Hirano et al. |

FOREIGN PATENT DOCUMENTS

| | | | |
|---|---|---|---|
| CH | 698 654 | B1 | 9/2009 |
| CN | 1790194 | A | 6/2006 |
| EP | 0 347 251 | A2 | 12/1989 |
| EP | 1 672 437 | A2 | 6/2006 |
| JP | S61-144493 | U | 9/1986 |
| JP | S62-255888 | A | 11/1987 |
| JP | 2001-324579 | A | 11/2001 |
| JP | 2006-170763 | A | 6/2006 |
| JP | 2010-223689 | A | 10/2010 |
| JP | 2010-243160 | A | 10/2010 |
| WO | WO 92/01977 | A1 | 2/1992 |

OTHER PUBLICATIONS

Extended European Search Report dated Mar. 19, 2019 received in European Patent Application No. EP 18196476.8.
First Office Action dated Apr. 15, 2020 in Chinese Patent Application No. CN 201811088484.4 together with an English language translation.
Notice of Reasons for Refusal dated Jun. 25, 2021 received in Japanese Patent Application No. JP 2017-185877 together with an English language translation.

*Primary Examiner* — Edwin A. Leon
*Assistant Examiner* — Jason M Collins
(74) *Attorney, Agent, or Firm* — Scully Scott Murphy & Presser

(57) ABSTRACT

A wheel train device including a dial plate having a display area provided between a central portion and an outer peripheral portion, a wheel train section having a pointer wheel to which a pointer that moves above the display area is attached, a supporting member which supports the wheel train section in an area corresponding to the display area, and a plurality of shaft attachment holes which are provided in a plurality of positions of the supporting member and to which the pointer wheel is selectively attached in one of the plurality of positions.

9 Claims, 9 Drawing Sheets

WHEEL TRAIN DEVICE AND TIMEPIECE

CROSS-REFERENCE TO RELATED APPLICATION

This application is based upon and claims the benefit of priority from the prior Japanese Patent Application No. 2017-185877, filed Sep. 27, 2017, the entire contents of which are incorporated herein by reference.

BACKGROUND OF THE INVENTION

1. Field of the Invention

The present invention relates to a wheel train device used for a timepiece such as a wristwatch and a timepiece including the same.

2. Description of the Related Art

For example, a wristwatch is known which includes a wheel train section which transmits rotation of a motor to a pointer wheel using a plurality of intermediate wheels and is structured to move a pointer attached to a pointer shaft of the pointer wheel in the wheel train section, as described in Japanese Patent Application Laid-Open (Kokai) Publication No. 2001-324579.

The wheel train section in this wristwatch is structured such that the plurality of intermediate wheels and the pointer wheel are rotatably supported by at least two upper and lower supporting members. That is, each of the two supporting members is provided with a plurality of shaft attachment holes for respectively supporting the top and bottom of shaft sections of the plurality of intermediate wheels and the top and bottom of the pointer shaft of the pointer wheel to correspond to each other.

In this wristwatch, when the installation position of the pointer is changed, the installation position of the pointer wheel needs to be changed. Correspondingly, the position of the shaft attachment hole in the supporting member must be changed. Accordingly, the supporting member must be newly manufactured and replaced.

SUMMARY OF THE INVENTION

An object of the present invention is to provide a wheel train device by which a supporting member is not required to be replaced and the installation position of a pointer can be easily changed, and a timepiece including the same.

In accordance with an aspect of the present invention, there is provided a wheel train device comprising: a dial plate having a display area provided between a central portion and an outer peripheral portion; a wheel train section having a pointer wheel to which a pointer that moves above the display area is attached; a supporting member which supports the wheel train section in an area corresponding to the display area; and a plurality of shaft attachment holes which are provided in a plurality of positions of the supporting member and to which the pointer wheel is selectively attached in one of the plurality of positions.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

A first embodiment will be described below with reference to FIG. 1 to FIG. 7.

Figure 1:
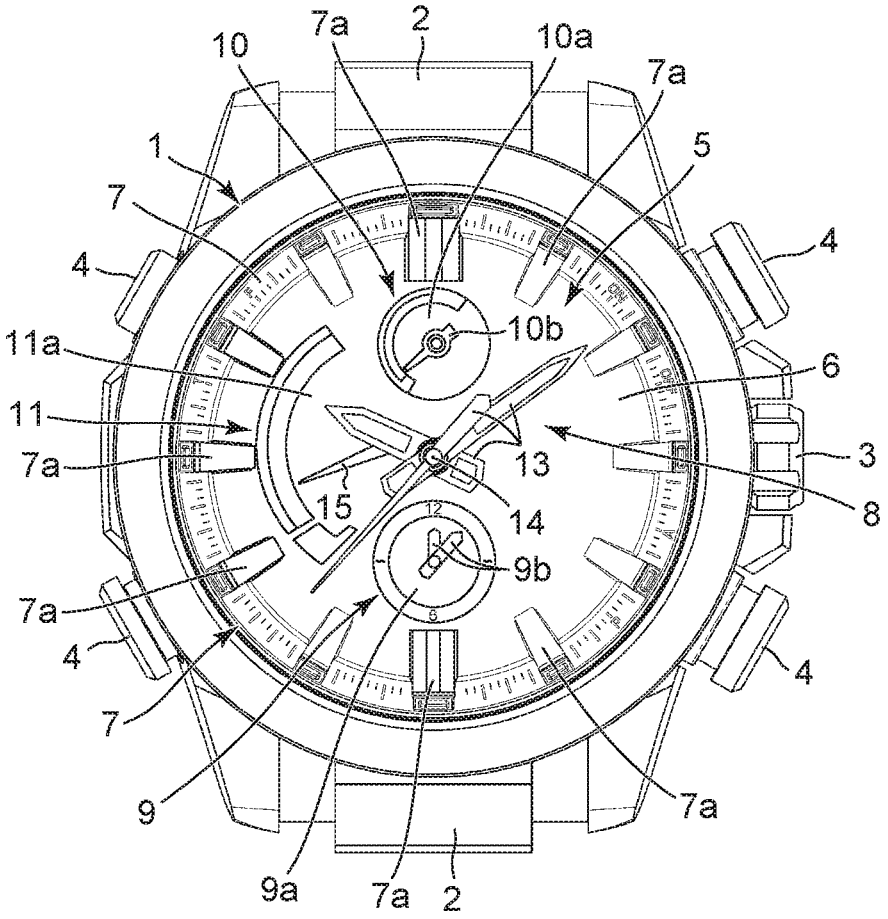
FIG. 1 is an enlarged front view showing a first embodiment.

This wristwatch includes a wristwatch case 1, as shown in FIG. 1. In side portions of the wristwatch case 1 on the six o'clock side and the twelve o'clock side, band attaching sections 2 are respectively provided.

In a side portion of the wristwatch case 1 on the 3 o'clock side, a switch operation section 3 such as a crown is provided, as shown in FIG. 1. In side portions of the wristwatch case 1 on the 2 o'clock side, the 4 o'clock side, the 8 o'clock side and the 10 o'clock side, push-button switches 4 are respectively provided. Inside the wristwatch case 1, a timepiece module 5 is provided.

Figure 2:
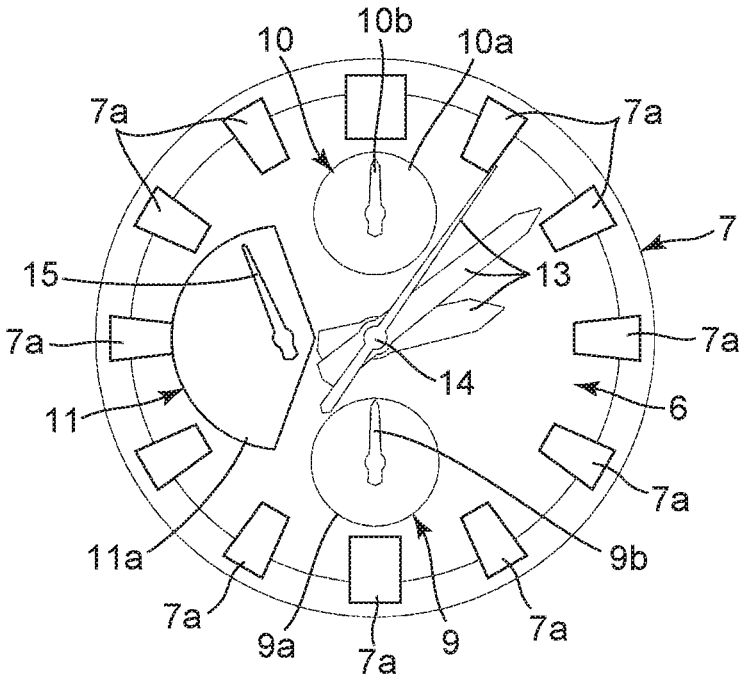
FIG. 2 is an enlarged front view showing a timepiece module incorporated into a wristwatch shown in FIG. 1.

This timepiece module 5 includes a substantially disk-shaped dial plate 6 arranged on its upper surface and a ring-shaped parting member 7 arranged in an outer peripheral portion on the upper surface of the dial plate 6, as shown in FIG. 1 and FIG. 2. On the upper surface of the parting member 7, a plurality of hour marks 7*a* are provided at equal intervals along a circumferential direction.

Figure 6:
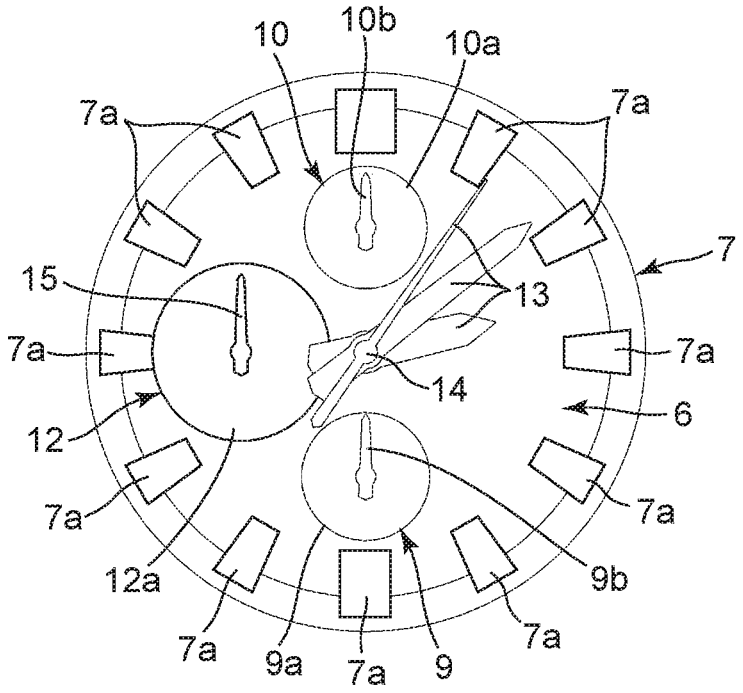
FIG. 6 is an enlarged front view showing a state where the installation position of a third sub-pointer has been changed in a different third sub-display area in the timepiece module shown in FIG. 2.

This timepiece module 5 also includes a main display section 8 (a main display area) which indicates the current time, a first sub-display section 9 which indicates the world time, a second sub-display section 10 which indicates a day of the week, and two types of third sub-display sections 11 and 12 which indicate a stop watch function and a remaining amount of a battery, as shown in FIG. 1, FIG. 2 and FIG. 6.

The main display section 8, which indicates the current time, includes pointers 13 such as a second hand, a minute hand, and an hour hand which is provided in a central portion of the dial plate 6 and moves above the dial plate 6, and a pointer shaft 14 which protrudes upward in the central portion of the dial plate 6 and to which each of the pointers 13 is attached, as shown in FIG. 1 and FIG. 2. By this structure, each of the pointers 13 moves above the dial plate 6 as the pointer shaft 14 rotates, and indicates an hour mark 7*a* on the parting member 7 in the main display section 8, whereby the current time is indicated.

The first sub-display section 9 is a section which indicates the time of one of the cities in the world, as shown in FIG. 1 and FIG. 2. This first sub-display section 9 includes a substantially circular-shaped first sub-display area 9*a* provided between the central portion of the dial plate 6 and an outer peripheral portion of the dial plate 6 on the 6 o'clock side and a first sub-pointer 9*b* which moves in an upper portion of the first sub-display area 9*a*. By this structure, the first sub-pointer 9*b* moves in the upper portion of the first sub-display area 9*a* in the first sub-display section 9, whereby the time of the selected city is indicated.

The second sub-display section 10, which is a section which indicates a day of the week, includes a substantially circular-shaped second sub-display area 10*a* provided between the central portion of the dial plate 6 and an outer peripheral portion of the dial plate 6 on the 12 o'clock side and a second sub-pointer 10*b* which moves in an upper portion of the second sub-display area 10*a*, as shown in FIG. 1 and FIG. 2. By this structure, the second sub-pointer 10*b* moves in the upper portion of the second sub-display area 10*a* in the second sub-display section 10, whereby the day of the week is selectively indicated.

One of the two types of third sub-display sections 11 and 12, that is, the third sub-display section 11 is a section which indicates a stop watch time, and includes a substantially fan-shaped third sub-display area 11*a* provided between the central portion of the dial plate 6 and an outer peripheral portion of the dial plate 6 on the 9 o'clock side and a third sub-pointer 15 which moves in an upper portion of the third sub-display area 11*a*, as shown in FIG. 1 and FIG. 2. By this structure, the stop watch time is indicated by the third sub-pointer 15 moving back and forth by a retrograde mechanism in the upper portion of the third sub-display area 11*a* for each 1/20 second in the third sub-display section 11.

The other third sub-display section 12 of the two types of third sub-display sections 11 and 12 is a section which indicates the remaining amount of the battery, and includes a substantially circular-shaped third sub-display area 12*a* provided between the central portion of the dial plate 6 and the outer peripheral portion of the dial plate 6 on the 9 o'clock side and a third sub-pointer 15 which moves in an upper portion of the third sub-display area 12*a*, as shown in FIG. 6. By this structure, the third sub-pointer 15 moves in the upper portion of the third sub-display area 12*a* in the other third sub-display section 12, whereby the remaining amount of the battery is indicated.

Figure 3:
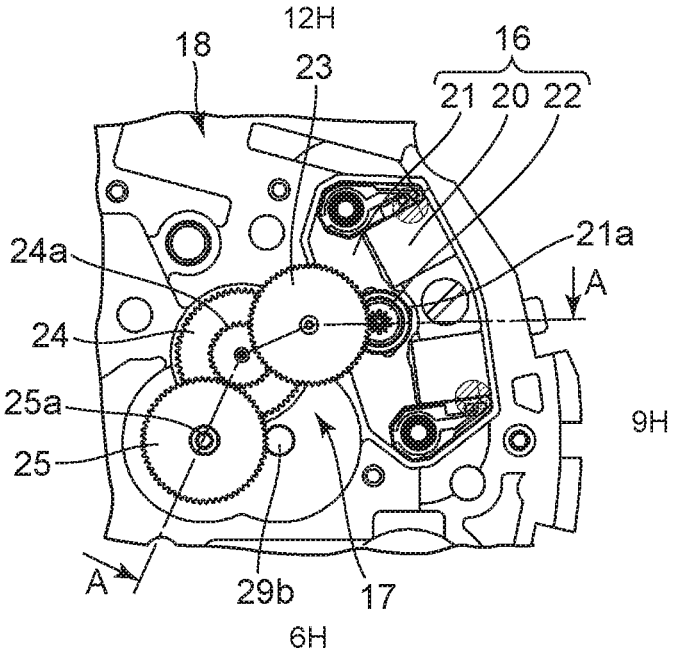
FIG. 3 is an enlarged rearview of the main portion showing a wheel train state in a third sub-display area shown in FIG. 2.
Figure 4:
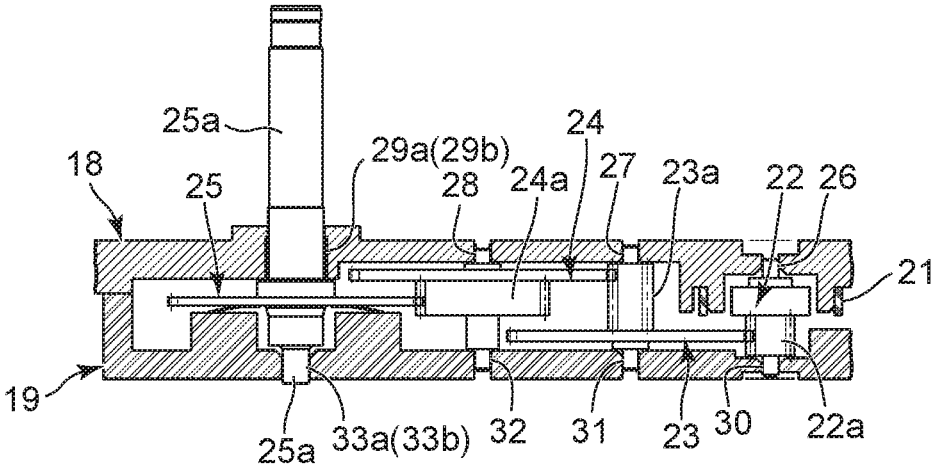
FIG. 4 is an enlarged sectional view showing the main portion of the timepiece module taken along line A-A in FIG. 3.
Figure 7:
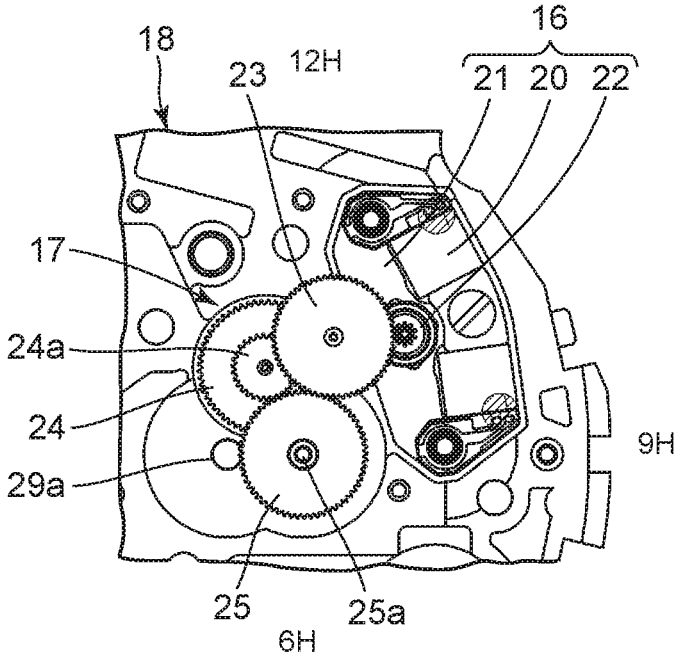
FIG. 7 is an enlarged rear view of the main portion showing a wheel train state in the third sub-display area shown in FIG. 6.

Each of the two types of third sub-display sections 11 and 12 includes a stepping motor 16 and a wheel train section 17, as shown in FIG. 3, FIG. 4 and FIG. 7, and the stepping motor 16 and the wheel train section 17 are attached between the first supporting member 18 and the second supporting member 19. The stepping motor 16 includes a coil section 20, a stator 21 which introduces a magnetic field intermittently generated in the coil section 20, and a rotor 22 which is arranged in a stator hole 21*a* provided in a central portion of the stator 21 and intermittently rotates in accordance with the magnetic field intermittently generated in the coil section 20.

The wheel train section 17 includes a first intermediate wheel 23 which rotates as the rotor 22 in the stepping motor 16 rotates, a second intermediate wheel 24 which rotates as the first intermediate wheel 23 rotates, and a sub-pointer wheel 25 which rotates as the second intermediate wheel 24 rotates, and is structured such that the third sub-pointer 15 is attached to a sub-pointer shaft 25*a* in the sub-pointer wheel 25, as shown in FIG. 3 and FIG. 4.

That is, the first intermediate wheel 23 rotates while engaging with a rotor pinion 22*a* in the rotor 22 in the stepping motor 16, as shown in FIG. 3 and FIG. 4. The second intermediate wheel 24 rotates while engaging with a first pinion 23*a* in the first intermediate wheel 23. The sub-pointer wheel 25 rotates while engaging with a second pinion 24*a* in the second intermediate wheel 24.

The first and second supporting members 18 and 19 are respectively provided corresponding to third sub-display areas 11*a* and 12*a* in the two types of third sub-display sections 11 and 12 positioned between the central portion of the dial plate 6 and the outer peripheral portion of the dial plate 6 on the 9 o'clock side, as shown in FIG. 2 to FIG. 5. The first supporting member 18 is provided with a shaft attachment hole 26 which supports the top of a rotor shaft of the rotor 22, a shaft attachment hold 27 which supports the top of a first shaft of the first intermediate wheel 23, a shaft attachment hole 28 which supports the top of a second shaft of the second intermediate wheel 24, and two types of first and second shaft attachment holes 29*a* and 29*b* which support the sub-pointer shaft 25*a* in the sub-pointer wheel 25.

Figure 5:
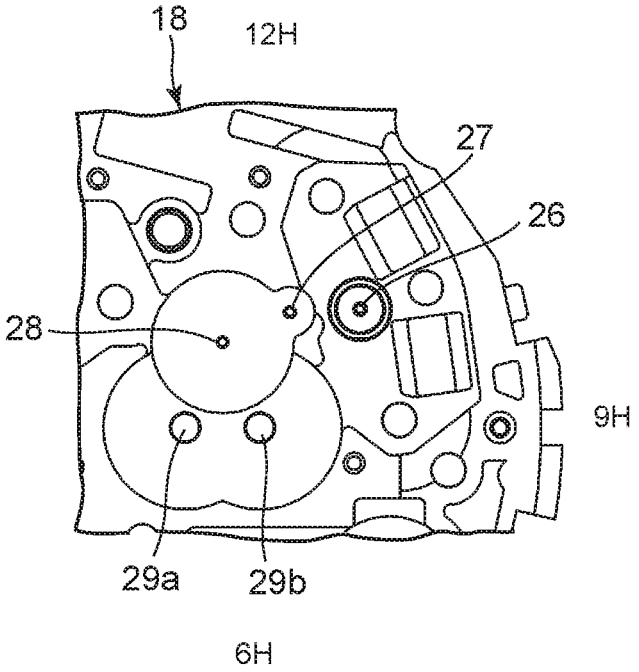
FIG. 5 is an enlarged rear view of the main portion showing a supporting member in the third sub-display area shown in FIG. 3.

The two types of first and second shaft attachment holes 29*a* and 29*b* are respectively holes into which the sub-pointer shaft 25*a* in the sub-pointer wheel 25 which protrudes upward from the first supporting member 18 is selectively inserted, and are provided in the first supporting member 18 such that the sub-pointer shaft 25*a* in the sub-pointer wheel 25 is selectively attached to one of the first and second shaft attachment holes 29*a* and 29*b*, as shown in FIG. 3 to FIG. 7. That is, the first and second shaft attachment holes 29*a* and 29*b* are provided on a circumference centered at the rotation center of the second intermediate wheel 24 which engages with the sub-pointer wheel 25, as shown in FIG. 5.

As a result, the sub-pointer wheel 25 is structured such that the sub-pointer shaft 25*a* is inserted into the first shaft attachment hole 29*a* as shown in FIG. 4, and is arranged in an area central to a substantially fan shape of the third sub-display area 11*a* in the third sub-display section 11 of the two types of third sub-display sections 11 and 12, i.e., a position close to the pointer shaft 14 in the main display section 8 so as to move the third sub-pointer 15 back and forth in the upper portion of the third sub-display area 11*a* with the third sub-pointer 15 being attached to the sub-pointer shaft 25*a*, as shown in FIG. 2.

This sub-pointer wheel 25 is also structured such that the sub-pointer shaft 25*a* is inserted into the second shaft attachment hole 29*b* as shown in FIG. 7, and is arranged in a substantially circular-shaped central portion of the third sub-display area 12*a* in the other third sub-display section 12 of the two types of third sub-display sections 11 and 12, i.e., a position away from the pointer shaft 14 in the main display section 8 so as to move the third sub-pointer 15 in the upper portion of the third sub-display area 12*a* with the third sub-pointer 15 being attached to the sub-pointer shaft 25*a*.

On the other hand, as shown in FIG. 4, the second supporting member 19 is provided with a shaft attachment hole 30 which supports the bottom of a rotor shaft of the rotor 22, a shaft attachment hole 31 which supports the bottom of a first shaft of the first intermediate wheel 23, a shaft attachment hole 32 which supports the bottom of a second shaft of the second intermediate wheel 24, and two types of first and second shaft attachment holes 33*a* and 33*b* which support the bottom of the sub-pointer shaft 25*a* in the sub-pointer wheel 25, as in the case of the first supporting member 18.

The two types of first and second shaft attachment holes 33*a* and 33*b* are also holes into which the sub-pointer shaft 25*a* in the sub-pointer wheel 25 is selectively inserted, and are provided in the second supporting member 19 such that the sub-pointer shaft 25*a* in the sub-pointer wheel 25 is selectively attached to one of the first and second shaft attachment holes 33*a* and 33*b*, as shown in FIG. 3 to FIG. 7. The first and second shaft attachment holes 33*a* and 33*b* are provided on the circumference centered at the rotation center of the second intermediate wheel 24 which engages with the sub-pointer wheel 25, as with the first and second shaft attachment holes 29*a* and 29*b* in the first supporting member 18.

Next, the mechanism of this wristwatch is described.

In this wristwatch, one of the two types of third sub-display sections 11 and 12 can be selectively provided. In the case where the third sub-display section 11 is selected, for example, the stepping motor 16 and the wheel train section 17 are first arranged in the first supporting member 18 with the first supporting member 18 being turned over, as shown in FIG. 3.

Here, the top of the rotor shaft of the rotor 22 in the stepping motor 16 is inserted into and supported on the shaft attachment hole 26 in the first supporting member 18. The top of the first shaft of the first intermediate wheel 23 in the wheel train section 17 is inserted into the shaft attachment hole 27 in the first supporting member 18, so that the first intermediate wheel 23 engages with the rotor pinion 22*a* in the rotor 22. The top of the second shaft of the second intermediate wheel 24 in the wheel train section 17 is inserted into the shaft attachment hole 28 in the first supporting member 18, so that the second intermediate wheel 24 engages with the first pinion 23*a* in the first intermediate wheel 23.

In this state, the sub-pointer wheel 25 is arranged in the first supporting member 18. Here, the sub-pointer shaft 25*a* in the sub-pointer wheel 25 is inserted into, of the two types of first and second attachment holes 29*a* and 29*b* in the first supporting member 18, the first shaft attachment hole 29*a* located close to the central portion of the dial plate 6, so that the sub-pointer wheel 25 engages with the second pinion 24*a* in the second intermediate wheel 24. As a result, the sub-pointer wheel 25 is arranged in the first supporting member 18 with the sub-pointer shaft 25*a* protruding upward from the first supporting member 18.

Then, the second supporting member 19 is arranged corresponding to the first supporting member 18. Here, the bottom of the rotor shaft of the rotor 22 in the stepping motor 16 is inserted into and supported on the shaft attachment hole 30 in the second supporting member 19. The bottom of the first shaft of the first intermediate wheel 23 is inserted into and supported on the shaft attachment hole 31 in the second supporting member 19. The bottom of the second shaft of the second intermediate wheel 24 is inserted into and supported on the shaft attachment hole 32 in the second supporting member 19.

Further, the bottom of the sub-pointer shaft 25*a* in the sub-pointer wheel 25 is inserted into and supported on, of the two types of first and second shaft attachment holes 33*a* and 33*b* in the second supporting member 19, the first shaft attachment hole 33*a* corresponding to the first shaft attachment hole 29*a* in the first supporting member 18. As a result, the stepping motor 16 and the wheel train section 17 are assembled between the first supporting member 18 and the second supporting member 19.

In this case, the sub-pointer shaft 25*a* in the sub-pointer wheel 25 is arranged at a position central to a substantially fan shape of the third sub-display area 11*a* in the third sub-display section 11. In this state, the third sub-pointer 15 is attached to the sub-pointer shaft 25*a* in the sub-pointer wheel 25 which protrudes upward from the first supporting member 18. As a result, the third sub-display section 11 has a display form where the third sub-pointer 15 moves in the upper portion of the substantially fan-shaped third sub-display area 11*a*, as shown in FIG. 1 and FIG. 2.

On the other hand, in the case where the other third sub-display section 12 of the two types of third sub-display sections 11 and 12, which is shown in FIG. 6, is selected, the stepping motor 16, the first intermediate wheel 23, and the second intermediate wheel 24 are arranged in the first supporting member 18 as shown in FIG. 7, as in the case where the above-described third sub-display section 11 is selected.

The sub-pointer shaft 25*a* in the sub-pointer wheel 25 is inserted into, of the two types of first and second attachment holes 29*a* and 29*b* in the first supporting member 18, the second shaft attachment hole 29*b* located far from the central portion of the dial plate 6, so that the sub-pointer wheel 25 engages with the second pinion 24*a* in the second intermediate wheel 24. As a result, the sub-pointer wheel 25 is arranged in the first supporting member 18 with the sub-pointer shaft 25*a* protruding upward from the first supporting member 18.

In this state, the second supporting member 19 is arranged corresponding to the first supporting member 18 so as to support the rotor 22, the first intermediate wheel 23, and the second intermediate wheel 24 in the stepping motor 16. Here, the bottom of the sub-pointer shaft 25*a* in the sub-pointer wheel 25 is inserted into and supported on, of the two types of first and second shaft attachment holes 33*a* and 33*b* in the second supporting member 19, the second shaft attachment hole 33*b* corresponding to the second shaft attachment hole 29*b* in the first supporting member 18.

As a result, the stepping motor 16 and the wheel train section 17 are assembled between the first supporting member 18 and the second supporting member 19. Here, the sub-pointer shaft 25*a* in the sub-pointer wheel 25 is arranged in the substantially circular-shaped central portion of the third sub-display area 12*a* in the other third sub-display section 12. In this state, the third sub-pointer 15 is attached to the sub-pointer shaft 25*a* in the sub-pointer wheel 25 which protrudes upward from the first supporting member 18. As a result, the third sub-display section 12 has a display form where the third sub-pointer 15 moves in the upper portion of the substantially circular-shaped third sub-display area 12*a*, as shown in FIG. 6.

Next, the use of the wristwatch is described.

In a normal state, the pointer shaft 14 in the main display section 8 rotates to move the pointers 13 such as the second hand, the minute hand and the hour hand above the dial plate 6, and the pointer 13 indicates an hour mark 7*a* on the parting member 7 arranged in the outer peripheral portion of the dial plate 6, whereby the current time can be known.

Also, here, the first sub-pointer 9*b* in the first sub-display section 9 moves in the upper portion of the first sub-display area 9*a* so as to indicate an hour mark (not shown) of the first sub-display area 9*a*, whereby the time of one of the cities in the world can be known. Similarly, in the second sub-display section 10, the second sub-pointer 10*b* moves in the upper portion of the second sub-display area 10*a* so as to indicate a day of the week in the second sub-display area 10*a*, whereby the day of the week can be known.

Also, here, when the third sub-display section 11 has been selected from the two types of third sub-display sections 11 and 12, an indicator of the third sub-display area 11*a* is indicated by the third sub-pointer 15 in the third sub-display section 11 moving back and forth by a retrograde mechanism for each 1/20 second in the upper portion of the substantially fan-shaped third sub-display area 11*a*, whereby a stop watch time can be known.

On the other hand, when the other one third sub-display section 11 has been selected from the two types of third sub-display sections 11 and 12, the third sub-pointer 15 in the third sub-display area 12 moves in the upper portion of the substantially circular-shaped third sub-display area 12*a* so as to indicate an indicator of the third sub-display area 12*a*, whereby the remaining amount of the battery can be known.

As described above, this wristwatch includes the dial plate 6 in which one of the two types of third sub-display areas 11*a* and 12*a* is provided between the central portion and the outer peripheral portion on the 9 o'clock side, the wheel train section 17 including the sub-pointer wheel 25 to which the third sub-pointer 15 that moves above the third sub-display areas 11*a* and 12*a* is attached, the first and second supporting members 18 and 19 which respectively support the wheel train section 17 in areas corresponding to the third sub-display areas 11*a* and 12*a*, and the first and second shaft attachment holes 29*a* and 29*b* and the first and second shaft attachment holes 33*a* and 33*b* which are provided in plural areas of the first and second supporting members 18 and 19 and to which the sub-pointer wheel 25 is selectively attached. As a result, the first and second supporting members 18 and 19 need not be replaced, and the installation position of the third sub-pointer 15 can be easily changed.

That is, in this wristwatch, the first and second shaft attachment holes 29*a* and 29*b* provided in the plurality of positions of the first supporting member 18 and the first and second shaft attachment holes 33*a* and 33*b* provided in the plurality of positions of the second supporting member 19 respectively correspond to each other, and the sub-pointer wheel 25 in the wheel train section 17 can be selectively attached to either one of the two sets of shaft attachment holes. Accordingly, the first and second supporting members 18 and 19 need not be replaced, and the installation position of the sub-pointer shaft 25*a* in the sub-pointer wheel 25 can be changed, whereby the installation position of the third sub-pointer 15 can be easily changed.

Also, in this wristwatch, the wheel train section 17 includes the first and second intermediate wheels 23 and 24 which transmit the rotation of the stepping motor 16 to the sub-pointer wheel 25, and the first and second shaft attachment holes 29*a* and 29*b* and the first and second shaft attachment holes 33*a* and 33*b* are provided on the circumference centered at the rotation center of the second intermediate wheel 24 which engages with the sub-shaft wheel 25. As a result, even when the sub-pointer shaft 25*a* in the sub-pointer wheel 25 is attached to either the first shaft attachment holes 29*a* and 33*a* or the second shaft attachment holes 29*b* and 33*b*, the sub-pointer wheel 25 can be reliably and favorably rotated by the second intermediate wheel 24.

Also, in this wristwatch, the two types of third sub-display sections 11 and 12 are respectively provided in different dial plates 6, and the third sub-display sections 11 and 12 respectively include the two different third sub-display areas 11*a* and 12*a*. By the third sub-pointer 15 being moved within the third sub-display area 11*a* of the two third sub-display areas 11*a* and 12*a*, a stop watch time can be known. By the third sub-pointer 15 being moved within the other third sub-display area 12*a*, the remaining amount of the battery can be known.

That is, the two types of third sub-display areas 11*a* and 12*a* differ in display form based on whether the sub-pointer wheel 25 is attached to the first shaft attachment holes 29*a* and 33*a* or attached to the second shaft attachment holes 29*b* and 33*b*. As a result, the different two types of functions and the display shapes respectively corresponding to the two types of functions can be easily selected.

For example, in the case where the sub-pointer shaft 25 is attached to the first shaft attachment holes 29*a* and 33*a*, the third sub-display area 11*a* is formed into a substantially fan shape, and the sub-pointer shaft 25*a* in the sub-pointer wheel 25 is arranged in an area central to the substantially fan shape. As a result, a stop watch time can be indicated by the third sub-pointer 15 moving back and forth by a retrograde mechanism for each 1/20 second in the upper portion of the substantially fan-shaped third sub-display area 11*a*.

Also, in the case where the sub-pointer shaft 25 is also attached to the second shaft attachment holes 29*b* and 33*b*, the third sub-display area 12*a* is formed into a substantially circular shape, and the sub-pointer shaft 25*a* in the sub-pointer wheel 25 is arranged in a central portion of the circular shape. As a result, the remaining amount of the battery can be indicated by moving the third sub-pointer 15 in the upper portion of the substantially circular-shaped third sub-display area 12*a*.

Second Embodiment

Next, a second embodiment is described with reference to FIG. 8 and FIG. 9. Sections that are the same as those of the first embodiment shown in FIG. 1 to FIG. 7 are provided with the same reference numerals.

Figure 8:
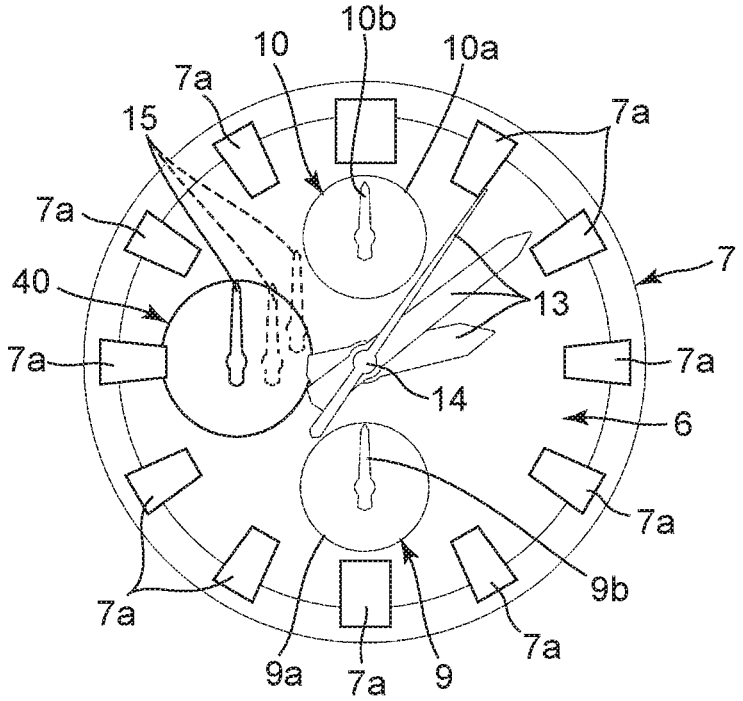
FIG. 8 is an enlarged front view showing a timepiece module in a second embodiment.
Figure 9:
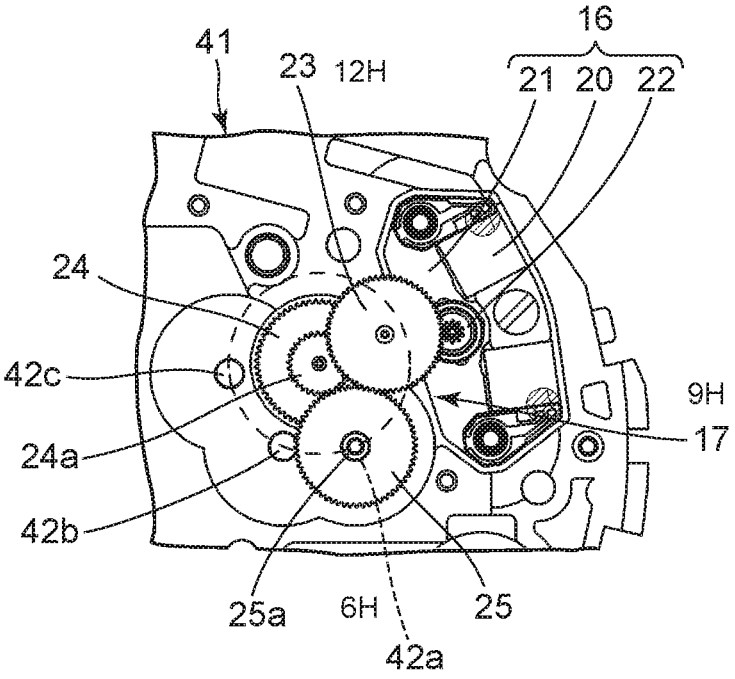
FIG. 9 is an enlarged rearview of the main portion showing an example of a wheel train state in a third sub-display area shown in FIG. 8.

This wristwatch has a structure similar to that of the first embodiment except that the installation position of the third sub-pointer 15 can be changed to be in any one of three different areas, as shown in FIG. 8 and FIG. 9.

That is, as shown in FIG. 9, a first supporting member 41 corresponding to a third sub-display section 40 is structured such that the stepping motor 16 and the wheel train section 17 are arranged, as with the first embodiment. Also, in this case, the wheel train section 17 includes the first intermediate wheel 23 which rotates as the rotor 22 in the stepping motor 16 rotates, the second intermediate wheel 24 which rotates as the first intermediate wheel 23 rotates, and the sub-pointer wheel 25 which rotates as the second intermediate wheel 24 rotates, and is structured such that the third sub-pointer 15 is attached to the sub-pointer shaft 25*a* in the sub-pointer wheel 25.

In this case, the first supporting member 41 is provided with three types of first to third shaft attachment holes 42*a* to 42*c*, as shown in FIG. 9. As a result, the sub-pointer wheel 25 is structured such that the sub-pointer shaft 25*a* is selectively attached to one of the first to third shaft attachment holes 42*a* to 42*c*. That is, the first to third shaft attachment holes 42*a* to 42*c* are provided on a circumference (a circumference indicated by a dotted line in FIG. 9) centered at a rotation center of the second intermediate wheel 24 which engages with the sub-pointer wheel 25.

Also, the stepping motor 16 and the wheel train section 17 are structured to be arranged with them being interposed between the first supporting member 41 and a second supporting member (not shown), as with the first embodiment. In this case, the second supporting member is also provided with three types of first to third shaft attachment holes (not shown) corresponding to the three types of first to third shaft attachment holes 42*a* to 42*c* provided in the first supporting member 41.

As a result, the third sub-display section 40 is structured such that three types of display forms, i.e., three types of display functions and three types of display shapes are acquired because the installation position of the sub-pointer shaft 25*a* in the sub-pointer wheel 25 is changed to be in one of three areas when the sub-pointer shaft 25*a* is selectively attached to one of the first to third shaft attachment holes 42*a* to 42*c*, as shown in FIG. 8.

In this wristwatch, the first to third shaft attachment holes 42*a* to 42*c* provided in a plurality of positions of the first supporting member 41 and first to third shaft attachment holes (not shown) provided in a plurality of positions of the second supporting member (not shown) respectively correspond to each other, and the sub-pointer wheel 25 in the wheel train section 17 can be selectively attached to one of the three sets of shaft attachment holes. As a result of this structure, the first and second supporting members 41 need not be replaced, and the installation position of the sub-pointer shaft 25*a* in the sub-pointer wheel 25 can be changed to be in one of the three areas, whereby the installation position of the third sub-pointer 15 can be easily changed, as with the first embodiment.

Also, in this wristwatch, the wheel train section 17 includes the first and second intermediate wheels 23 and 24 which transmit the rotation of the stepping motor 16 to the sub-pointer wheel 25, and the first to third shaft attachment holes 42*a* to 42*c* are provided on the circumference centered at the rotation center of the second intermediate wheel 24 which engages with the sub-shaft wheel 25. As a result, even when the sub-pointer shaft 25*a* in the sub-pointer wheel 25 is attached to one of the first to third shaft attachment holes 42*a* to 42*c*, the sub-pointer wheel 25 can be reliably and favorably rotated by the second intermediate wheel 24.

Moreover, in this wristwatch, by the sub-pointer shaft 25*a* in the sub-pointer wheel 25 being selectively attached to one of the first to third shaft attachment holes 42*a* to 42*c*, the installation position of the sub-pointer shaft 25*a* can be changed to be in one of the three areas. Accordingly, the third sub-display section 40 can be easily changed to be in one of the three types of display forms, or in other words, the third sub-display section 40 can be easily changed to have one of the three types of display functions and one of the three types of display shapes in accordance with the installation position of the sub-pointer shaft 25*a*.

In the above-described first and second embodiments, the installation position of the sub-pointer shaft 25 is changed to be in one of the two or three areas. However, the present invention is not limited thereto, and a structure may be adopted in which shaft attachment holes are provided in four or more areas on the circumference centered at the rotation center of the second intermediate wheel 24 which engages with the sub-pointer wheel 25, whereby the installation position of the sub-pointer wheel 25 can be changed to be in one of four or more areas.

Also, in the above-described first and second embodiments, the wheel train section 17 includes the first intermediate wheel 23 and the second intermediate wheel 24. However, the present invention is not limited thereto. For example, a structure may be adopted in which the wheel train section 17 includes only one intermediate wheel. In addition, a structure may be adopted in which the wheel train section 17 includes three or more intermediate wheels. In these structures, a plurality of shaft attachment holes are provided on the circumference centered at the rotation center of the intermediate wheel which engages with the sub-pointer wheel 25.

Moreover, in the above-described first and second embodiments, the present invention has been applied to the third sub-pointer 15 in each of the third sub-display sections 11, 12 and 40. However, the present invention is not limited thereto. For example, the present invention is also applicable to the first sub-pointer 9*b* in the first sub-display section 9 and the second sub-pointer 10*b* in the second sub-display section 10.

Furthermore, in the first and second embodiments and the modification examples described above, the present invention has been applied to a pointer-type wristwatch. However, the present invention is not necessarily required to be applied to a wristwatch. For example, the present invention is applicable to various types of pointer-type timepieces such as a travel watch, an alarm clock, a table clock, and a wall clock.

While the present invention has been described with reference to the preferred embodiments, it is intended that the invention be not limited by any of the details of the description therein but includes all the embodiments which fall within the scope of the appended claims.

What is claimed is:

1. A wheel train device comprising:

a dial plate having a display area provided between a central portion of the dial plate and an outer peripheral portion of the dial plate;

a wheel train section comprising:

a pointer wheel to which a pointer that moves above the display area is attached; and an intermediate wheel configured to rotate the pointer wheel; and a supporting member configured to support the wheel train section in an area corresponding to the display area, wherein the supporting member defines a plurality of shaft attachment holes which are provided in a plurality of positions of the supporting member and to which the pointer wheel is selectively attached, wherein the pointer wheel is configured to be attached to a first shaft attachment hole of the plurality of shaft attachment holes to engage with and to be rotated by the intermediate wheel, and the pointer wheel is configured to be attached to a second shaft attachment hole of the plurality of shaft attachment holes to engage with and to be rotated by the intermediate wheel, wherein the pointer wheel, when selectively attached to the first shaft attachment hole, provides a first angular range of movement to the pointer, and, when selectively attached to the second shaft attachment hole of the plurality of shaft attachment holes, provides a second angular range of movement to the pointer different from the first angular range of movement, and wherein the first angular range of movement and the second angular range of movement at least partially overlap each other.

2. The wheel train device according to claim 1, wherein the intermediate wheel is configured to transmit rotation of a motor to the pointer wheel to rotate the pointer wheel, and wherein the plurality of shaft attachment holes are provided in a circumference centered at a rotation center of the intermediate wheel.

3. The wheel train device according to claim 2, wherein a main display area is provided in the central portion of the dial plate, wherein the display area is a sub-display area, and wherein the pointer is a sub-pointer which moves in the sub-display area.

4. The wheel train device according to claim 3, wherein a display form of the sub-display area varies in accordance with an attachment of the pointer wheel to the first shaft attachment hole and with an attachment of the pointer wheel to the second shaft attachment hole.

5. The wheel train device according to claim 1, wherein a main display area is provided in the central portion of the dial plate, wherein the display area is a sub-display area, and wherein the pointer is a sub-pointer which moves in the sub-display area.

6. The wheel train device according to claim 5, wherein a display form of the sub-display area varies in accordance with an attachment of the pointer wheel to the first shaft attachment hole and with an attachment of the pointer wheel to the second shaft attachment hole.

7. A timepiece comprising the wheel train device according to claim 1.

8. The wheel train device according to claim 1, wherein the first shaft attachment hole is arranged a first distance from the central portion of the dial plate, and wherein the second shaft attachment hole is arranged a second distance from the central portion of the dial plate, where the second distance is different from the first distance.

9. The wheel train device according to claim 8, wherein the second distance is shorter than the first distance, wherein the second angular range of movement is a fan-shaped range of movement, and wherein the first angular range of movement is a circular range of movement.

* * * * *